US008659979B2

(12) United States Patent
Tsuji et al.

(10) Patent No.: US 8,659,979 B2
(45) Date of Patent: Feb. 25, 2014

(54) INNER FRAME AND CASE UNIT

(75) Inventors: Ayako Tsuji, Fuchu (JP); Masato Ueno, Tama (JP)

(73) Assignee: Casio Computer Co., Ltd, Tokyo (JP)

( * ) Notice: Subject to any disclaimer, the term of this patent is extended or adjusted under 35 U.S.C. 154(b) by 560 days.

(21) Appl. No.: 12/951,439

(22) Filed: Nov. 22, 2010

(65) Prior Publication Data

US 2011/0127278 A1 Jun. 2, 2011

(30) Foreign Application Priority Data

Nov. 30, 2009 (JP) ..... 2009-272034

(51) Int. Cl.
*G04C 23/02* (2006.01)
*G04B 37/00* (2006.01)
*G04B 29/00* (2006.01)

(52) U.S. Cl.
USPC ..... 368/88; 368/276; 368/300

(58) Field of Classification Search
USPC ..... 368/88, 276, 282, 297–300
See application file for complete search history.

(56) References Cited

U.S. PATENT DOCUMENTS 3,691,758 A * 9/1972 Schneider ..... 368/300
4,184,317 A * 1/1980 Kanda et al. ..... 368/300
4,207,735 A * 6/1980 Ishigaki et al. ..... 368/300
5,825,722 A * 10/1998 Meyrat et al. ..... 368/276
6,575,619 B1 * 6/2003 Stauffer ..... 368/299
7,307,921 B1 * 12/2007 Karterman ..... 368/88

FOREIGN PATENT DOCUMENTS

| | | |
|---|---|---|
| JP | 53-144369 | 12/1978 |
| JP | 60-095577 | 5/1985 |
| JP | 60-83991 | 6/1985 |
| JP | 62-193586 | 8/1987 |
| JP | 2007-132771 | 5/2007 |

OTHER PUBLICATIONS

Japanese Office Action for Japanese Application No. 2009-272034 mailed on Oct. 11, 2011.

* cited by examiner

*Primary Examiner* — Vit W Miska
(74) *Attorney, Agent, or Firm* — Turocy & Watson, LLP

(57) ABSTRACT

An inner frame includes a side wall being set its outer diameter to be smaller than a diameter of an inner periphery of a case and arranged along an inner peripheral surface of the case when the frame is housed within the case. The wall is divided into spread portions by cut outs, each cut out in a thickness direction of the case, and the spread portions are spread to make an outside surface thereof fit on the inner peripheral surface of the case when the module is press-fitted from an opening of the case. An inside surface of each spread portion is provided with a projection to be brought into contact with an outside surface of the module and to push and spread outward the spread portion when the module is press-fitted into the frame. A case unit includes the module, the case, and the frame.

7 Claims, 12 Drawing Sheets

INNER FRAME AND CASE UNIT

CROSS-REFERENCE TO RELATED APPLICATIONS

This application is based upon and claims the benefit of priority from prior Japanese Patent Application No. 2009-272034, filed Nov. 30, 2009, the entire contents of which are incorporated herein by reference.

BACKGROUND OF THE INVENTION

1. Field of the Invention

The present invention relates to an inner frame and a case unit.

2. Description of the Related Art

In a conventional case unit for use in an electronic device such as a wristwatch, etc, when a module member which holds various parts therein is incorporated into a case member as an outer case, an inner frame is disposed between the case member and the module member in order to prevent the module member from moving in the case member, so that the module member held in the module member is positioned and secured in a predetermined position in the case member.

For example, Japanese patent application KOKAI publication No. 2007-132771 discloses a timepiece which comprises a timepiece module and a body case housing the timepiece module, and which has a structure by which a inner frame as a pressing member is arranged for positioning and pressing the timepiece module in the body case.

In the past, in order to secure the inner frame to the case member without being rattling, one of the following constructions is employed, by which the inner frame is formed to set its outer diameter to be substantially equal to a diameter of an inner periphery of the case, projecting portions are provided on an outer side surface of the inner frame not to provide a gap between the inner frame and the case member, and the inner frame is press fitted into the case member.

However, in a case that the inner frame is made of plastic to increase its close fit to the module member and to the case member and the case member is made of a hard material such as metal, when the inner frame is pressed-into the case member, the outer surface of the inner frame is scraped off by friction generated between the outer surface of the inner frame and the inside surface of the case member, thereby producing shavings.

Especially, in a structure in which a cover member is threaded into an opening portion of the case member to cover the opening portion, when the inner frame is press-fitted into the case member, there is a large possibility that the inner frame contacts a threaded portion formed on an inner periphery of the opening portion of the case member and is scraped off.

For example, in a wristwatch, shavings produced from the inner frame may fall into a clearance between a front glass cover and a liquid crystal panel and/or onto electronic parts, thereby producing troubles.

If the diameter of the inner frame is set small than the inner diameter of the case member, the inner frame is prevented from being in contact with the case member and from being scraped by the case. But, the inner frame holding the module member may move within the case body and may be rattled. Thus, there is a need to provide a member such as a spacer to secure the inner frame, and it increases the number of parts and that of manufacturing steps. Finally, a manufacturing cost is increased.

The present invention is derived from the above described circumstances, and has an object to provide an inner frame with a simple structure which can prevent the inner frame from being scraped off by the case member even if it contacts the case member and which can secure the module member within the case, and a case unit.

BRIEF SUMMARY OF THE INVENTION

A case unit according to this invention comprises a module member which holds parts therein; a case member which includes an opening portion and which houses the module member; and an inner frame which has a side wall portion along an inner peripheral surface of this case member, which is arranged to be interposed between the case member and the module member, and which positions the module member within the case member and secures the module member to the case member.

The inner frame is formed to set an outer diameter thereof to be smaller than a diameter of an inner periphery of the case member, and at least one part of the side wall portion is configured as a spread portion which is spread by the module member so as to fit an outside surface thereof on the inner peripheral surface of the case member when the module member is press-fitted from a side of the opening portion.

An inner frame according to this invention is positioned and interposed between a module member holding parts therein and a case member housing the module member to position and secure the module member within the case member by press-fitting the module member from a side of an opening portion of the case member. The inner frame has a side wall portion which is formed to set an outer diameter thereof to be smaller than a diameter of an inner periphery of the case member and which is arranged along an inner peripheral surface of the case member when the inner frame is housed within the case member. The side wall portion is provided with a plurality of cut-out portions each of which is cut out in a direction of a thickness of the case member. One or each of all of parts of the sidewall portion located between the cut-out portions is configured as a spread portion which is spread by the module member so as to fit an outside surface thereof on the inner peripheral surface of the case member when the module member is press-fitted from a side of the opening portion. And, an inside surface of the spread portion is provided with an inner-frame side projecting portion which is brought into contact with an outside surface of the module member and which pushes and spreads outward the spread portion when the module member is press-fitted into the inner frame.

With this invention, since the outer diameter of the inner frame is set to be smaller than the inner diameter of the inner periphery of the case member, the inner frame is prevented from being in contact with the inner surface of the case member and hence is not scraped off by the inner surface when the inner frame is housed within the case.

Further, with this invention, when the module member is press-fitted into the inner frame, at least a part of the sidewall of the inner frame is pressed and spread outward by the module member and then brought into close contact with or fit the inner peripheral surface of the case member. Thus, after the press-fit of the module, the module member and the inner frame can be securely positioned and secured within the case member without rattling.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate an embodiment of the invention and various modifications thereof, and together with the general description given above and the detailed description of the embodiment and modifications given below, serve to explain the principles of the invention.

DETAILED DESCRIPTION OF THE INVENTION

Referring to the accompanying drawings, an embodiment of an inner frame according to the present invention and that of a case unit to which the inner frame is applied will be described concretely. By the way, in the following embodiment, the inner frame and the case unit are applied to a wristwatch, but a scope of the present invention is not limited to this embodiment.

Figure 1:
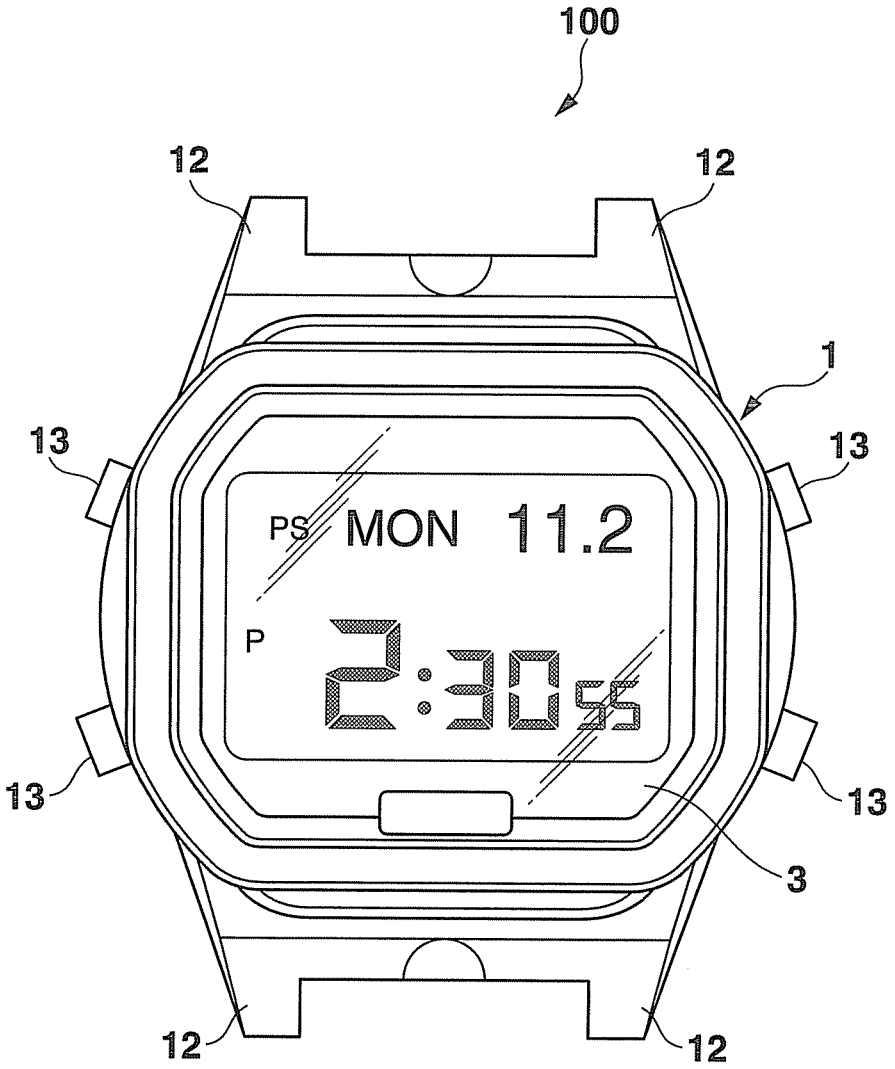
FIG. 1 is a front view showing a general structure of a wristwatch to which a case unit according to the present invention is applied.

FIG. 1 is a front view showing the wristwatch of the embodiment. As shown in FIG. 1, the wristwatch 100 is provided with a body case 1 as a case member.

Although a material forming the body case 1 is not specially limited, it is formed of a relatively hard material such as metal of, for example stainless steel, titanium or etc.

Figure 2:
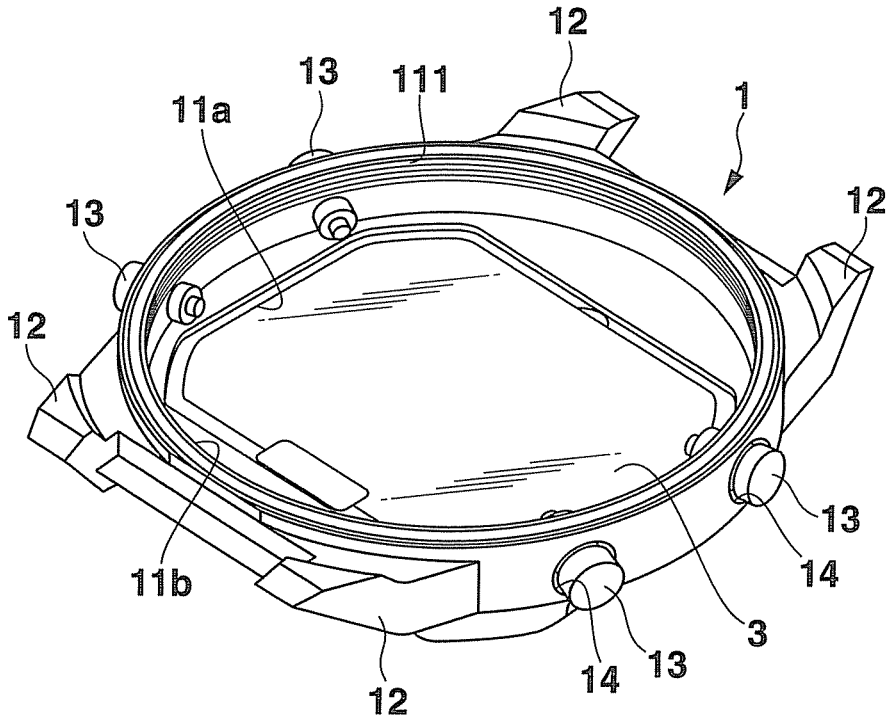
FIG. 2 is a perspective view showing a back side of a case member shown in FIG. 1.

FIG. 2 is a perspective view showing a back surface side of the body case 1 (the back side being opposite to a viewing side).

As shown in FIG. 2, the body case 1 is formed in a short columnar shape, and its inside is hollow both upper and lower of which are opened. This hollow portion is a housing portion providing a housing space for housing various parts.

As shown in FIG. 2, a watch-glass member 3 which is a cover member formed of transparent material is mounted on the viewing side (that is a front surface side: a lower side in FIG. 2) of the body case 1 to cover an opening portion 11*a* of the viewing-side. The cover member covering the opening portion 11*a* is not limited to one formed of glass.

At a side of the body case 1 being opposite to the viewing side (a back surface side: an upper side in FIG. 2), a back cover member (not shown) as a cover member for closing an opening portion 11*b* in the back surface side of the body case 1 is threaded.

That is, an outer peripheral surface of the threaded portion of the back cover member is formed as a male screw, and a threaded portion 111 as a female screw for receiving the male screw is formed in an inner peripheral surface of the opening portion 11*b* of the body case 1. The back cover member is attached to the body case 1 by threading or screwing the threaded portion of the back cover portion which is formed as the male screw into the threaded portion 111.

Further, on upper and lower end portions of the body case 1 in FIG. 1, band attaching portions 12 to which bands (not shown) are attached are formed.

More further, two operation buttons 13 through which various operation command such as a time setting is performed are provided at each of right and left on an outer peripheral portion of the body case 1. Through holes 14 are provided at positions on a side surface of the body case 1 to correspond to the operation buttons 13, and one end side of each operation button 13 projects into an inner side of the body case through the through hole 14 corresponding thereto.

A module member 4 which holds various parts (not shown) therein is housed in an inner portion of the body case 1 while the module member 4 is held by an inner frame 5.

In this embodiment, a case unit 10 (FIG. 6) is structured by the body case 1 as the case member, the inner frame 5 and the module member 4.

Figure 3:
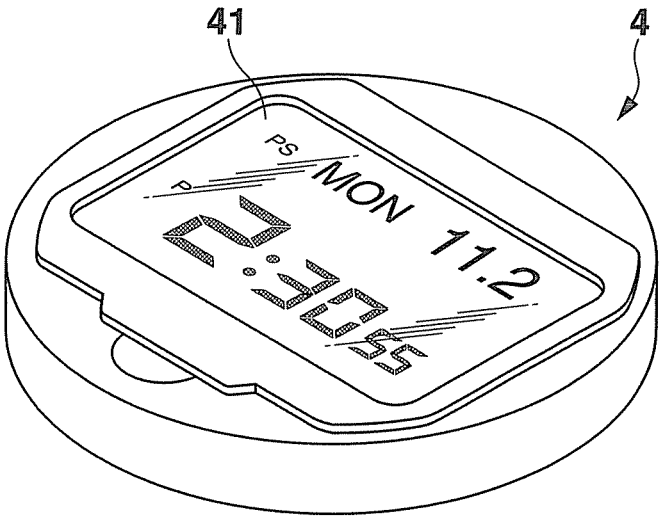
FIG. 3 is a perspective view of a module member housed in the case member shown in FIG. 1.

FIG. 3 is a perspective view of the module member 4 as viewed it from the viewing side (front surface side).

The module member 4 is formed in a form of a disc, for example, by plastic. Its outer diameter is substantially equal to a diameter of an inner periphery of an opening portion 52 (FIG. 5) of the inner frame 5. Parts such as circuit boards on which various electronic parts are mounted are housed in an inner portion of the inner frame 5, and a liquid crystal panel 41 providing a display portion is arranged on a surface of a viewing side (front surface side) of the inner frame 5. A structure, a shape and etc. of the liquid crystal panel 41 are not specially limited.

Figure 4:
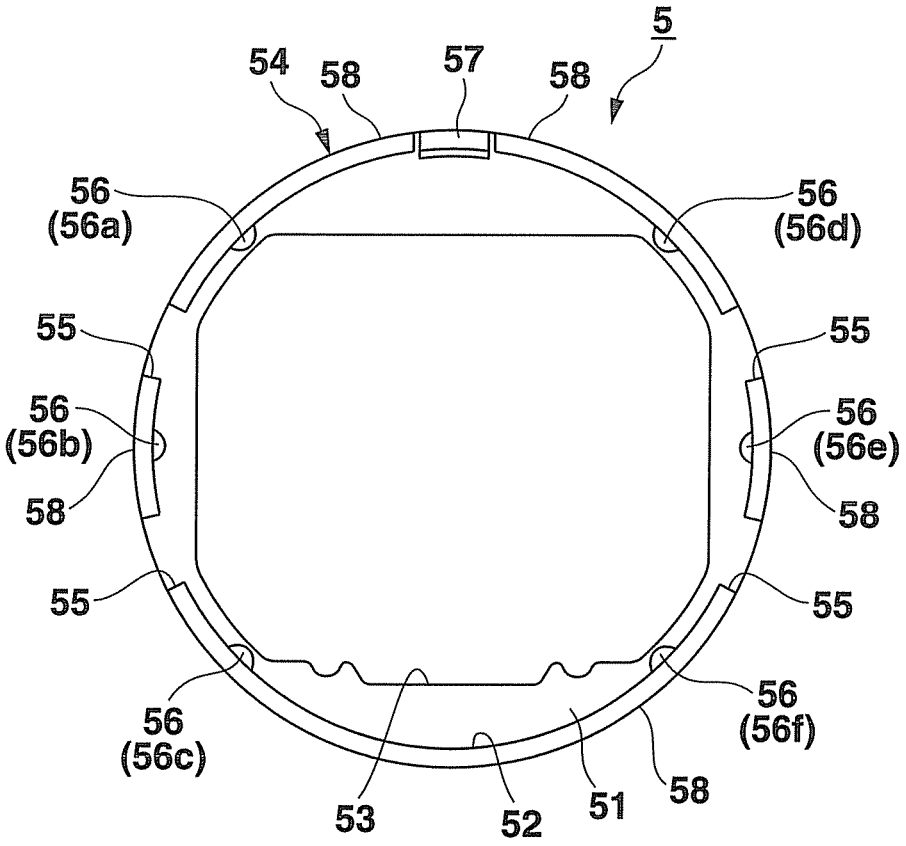
FIG. 4 is a plan view of a back side of an inner frame housed in the case member shown in FIG. 1.
Figure 5:
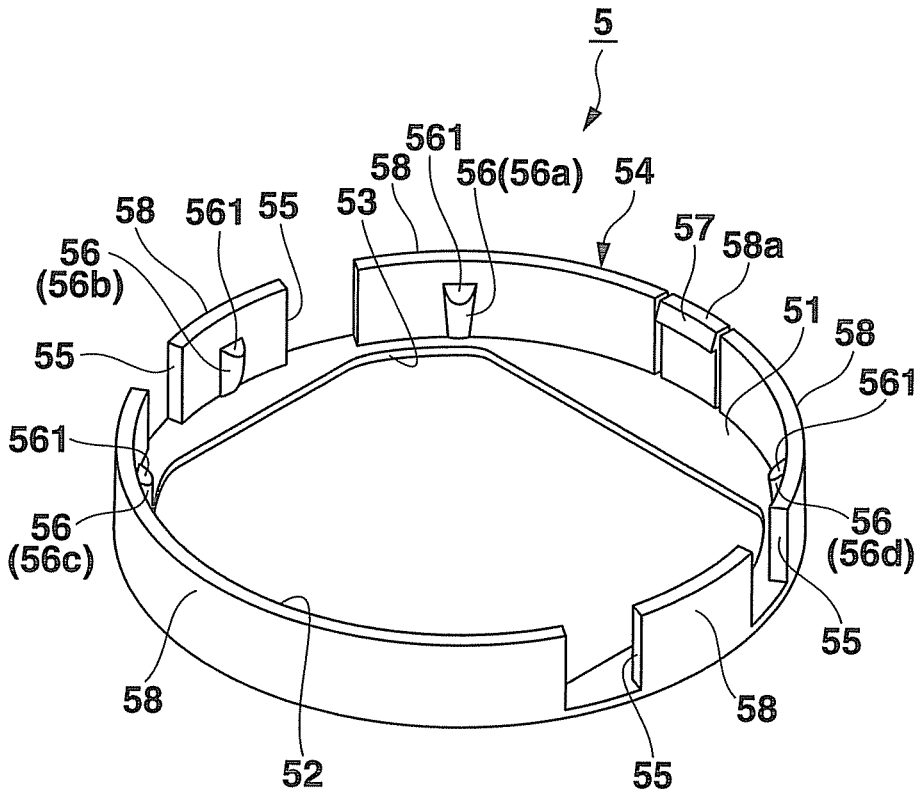
FIG. 5 is a perspective view of the inner frame shown in FIG. 4.

FIG. 4 is a plan view of the inner frame 5 of the present embodiment as viewed from its back surface side. FIG. 5 is a perspective view of the inner frame 5 as viewed from its back surface side.

The inner frame 5 is arranged and interposed between the body case 1 and the module member 4 to position and secure the module member 4 within the body case 1 so that the module member 4 will not rattle.

The inner frame 5 is made of a material having somewhat elasticity such as plastic and the like, but the material is not limited specifically.

The inner frame 5 is formed to have an outer diameter which is smaller than a diameter of an inner periphery of the body case 1. As a result of this, when the inner frame 5 is housed in the body case 1, an outer side surface of the inner frame 5 is not in contact with an inner peripheral surface of the body case 1 so that the outer side surface is not prevented from being shaped by a friction generated therebetween.

As shown in FIGS. 4 and 5, the inner frame 5 has a bottom portion 51 at its inner side in a direction in which the inner frame 5 is inserted into the body case 1, and its other end side is an opening portion 52.

A window portion 53 is provided in the bottom portion 51 to correspond to a shape of the liquid crystal panel 41 arranged on a surface of the module portion 4 so that the liquid crystal panel 41 is exposed through the window portion 53 when the module member 4 is housed in the inner frame 5.

Further, the inner frame 5 has a substantially vertically erecting sidewall portion 54 along a peripheral edge of the bottom portion 51.

The sidewall 54 is configured to have a shape along the inner peripheral surface of the body case 1 when the inner frame 5 is inserted into the body case 1. And, a height of the side wall 54 is so set that an upper end of the module member 4 and that of the side wall portion 54 are substantially flush with each other when the module member 4 is held within the inner frame 5.

In this embodiment, cut-out portions 55 are formed at positions in the side wall portion 54 corresponding to the four operation buttons 13 projecting inside of the body case 1 when the module member 4 is assembled in the body case 1. Each cut-out portion 55 is cut out in a thickness direction of the side wall portion 54 from the opening portion 52 to the bottom portion 51 (that is, the thickness direction is a thickness direction of the body case 1 when the inner frame 5 is assembled in the body case 1).

A width of each cut-out portion 55 is so set as to allow the operation button 13 to pass through each cut-out portion 55, but it is not specifically limited. Further, each cut-out portion 55 may reach the bottom portion 51 of the inner frame 5 or may reach at an intermediate position in the thickness direction of the inner frame 5.

In this embodiment, parts of the side wall portion 54 excluding the cut-out portions 55 (that is, the parts between the cut-out portions 55) are pushed and spread outward to bring their outer side surfaces to fit the inner peripheral surface of the body case 1 when the module member 4 is press-fitted into the frame member 5, so that they function as spread portions 58.

Although in this embodiment all of the parts of the side wall portion 54 excluding the cut-out portions 55 (that is, the parts between the cut-out portions 55) are pushed and spread outward 1 by the module member 4 to function as the spread portions 58, there is no need to function all of the parts of the side wall portion 54 between the cut-out portions 55 as the spread portions 58 and only one or each of some of the parts functions as the spread portion 58.

It is sufficient that at least one part of the side walls 54 functions as the spread portion 58, and a position and range of each part functioning as the spread portion 58 is not limited to that explained herein as one example.

A plurality of inner-frame side projecting portions 56 for being brought into contact with the outer side surface of the module member 4 and pushing and spreading outward the spread portions 58 when the module member 4 is press-fitted into the inner frame 5, are provided on inside surfaces of the parts of the side wall portion 54 functioning as the spread portions 58.

In this embodiment, as shown in FIGS. 4 and 5, each of six inner-frame side projecting portions 56*a*, 56*b*, 56*c*, 56*d*, 56*e*, and 56*f* is arranged adjacent each of the cut-out portions 55 while three of them are located left and the other three of them are located right. Although only four inner-frame side projecting portions 56 are shown in FIG. 5, the three inner-frame side projecting portions 56*a*, 56*b*, and 56*c* opposite the three inner-frame side projecting portions 56*d*, 56*e*, and 56*f*.

Positions on which the inner-frame side projecting portions are mounted and the number thereof are not specifically limited. However, in order to surely push and spread the spread portions 58 of the side wall portion 54 to fit them on the body case 1, it is preferable that two or more of the inner-frame side projecting portions (for example, the inner-frame side projecting portions 56*a* and 56*f* shown in FIG. 4) are mounted, and it is more preferable that four or more of the inner-frame side projecting portions (for example, the inner-frame side projecting portions 56*a*, 56*c*, 56*d*, and 56*f* shown in FIG. 4) are mounted symmetrically to a center of the bottom portion 51.

As shown in FIG. 5, each inner-frame side projecting portion 56 is provided to protrude gradually radially inwardly of the inner frame 5 while it extends from the bottom portion 51 towards the upper end of the side wall portion 54. An upper end portion of the inner-frame side projecting portion 56 is located below the upper end of the side wall portion 54, and an upper end surface of the inner-frame side projecting portion 56 is configured as a slanted surface 561 slanted to be lowered toward the inside of the inner-frame side projecting portion 56. As a result of this, when the module member 4 is press-fitted from the side of the opening portion 52 of the inner frame 5, the module 4 can be inserted without being cough by the inner-frame side projecting portion 56.

Figure 6:
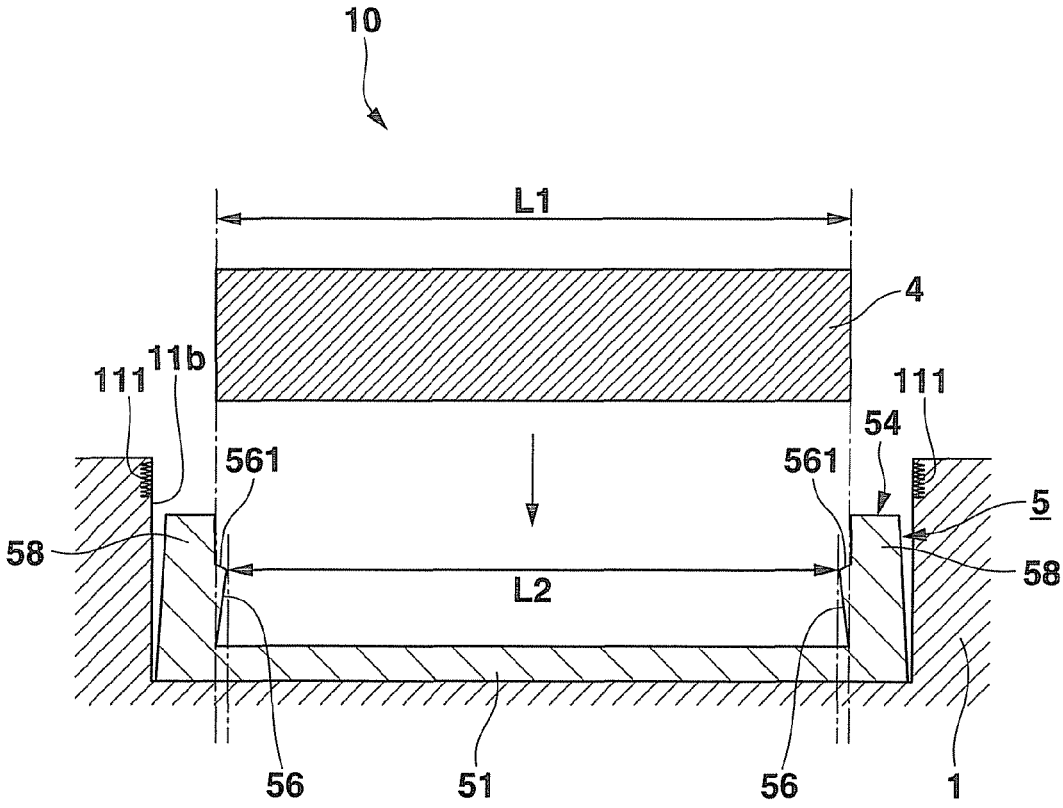
FIG. 6 is a vertical cross-sectional view schematically illustrating a state after the inner frame is housed in the case member shown in FIG. 1.

FIG. 6 is a vertical cross-sectional view schematically illustrating a state in which the inner frame 5 have been housed in the case member 1 and the module member 4 will be press-fitted from the opening portion 11*b*.

Figure 7:
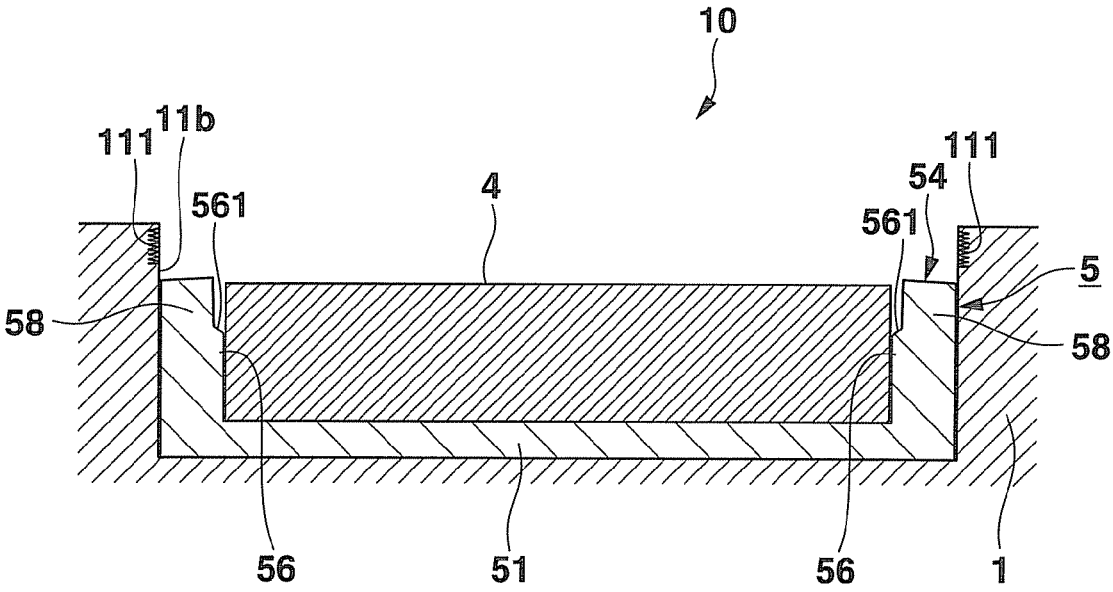
FIG. 7 is a vertical cross-sectional view schematically illustrating a state after the module is press-fitted into the inner frame shown in FIG. 6.

As shown in FIG. 6, before a state in which the module member 4 is press-fitted into the inner frame 5, L1>L2 wherein L1 is an outer diameter of the module member 4 and L2 is a diameter L2 between inner tips of the opposed inner-frame side protrusions 56. A diameter of the opening portion 52 of the inner frame 5 is substantially equal to the outer diameter L1 of the module member 4. Therefore, when the module 4 is press-fitted into from the opening portion 52 of the inner frame 5, a corner portion of the viewing side (the lower side in FIG. 6) of the module member 4 is brought into contact with the upper ends of the inner-frame side protrusions 56 and then the module member 4 is continuously pressed into the frame member 5 along the slanted surfaces 561 to spread the side wall portion 54 (the spread portions 58) of the inner frame 5 until a position at which the module member 4 is in contact with the bottom portion 51 of the inner frame 5 (Please refer to FIG. 7). As a result, the inner frame 5 is fit and secured while the outside surfaces of the spreading portions of the side wall portion 54 make surface contact with the inside surface of the body case 1.

An elastic arm 58*a* independent of the spread portions 58 is formed on the periphery of the bottom portion 51 of the inner frame 5 in one of the cut-out portions 55 to erect like the side wall portion 54 of the inner frame 5 from the bottom portion 51. An end of the elastic arm 58*a* directs upward in the wrist watch 100 when the inner frame 5 is assembled in the body case 1, and a hook portion 57 for engaging with the module member 4 is provided at the upper end of the elastic arm 58*a*. When the module member 4 is press-fitted in the inner frame 5, the hook portion 57 engages with the back surface side of the module member 4 to prevent the module member 4 from leaving off from the inner frame 5. The shape, provided position and the number of the hook portion 57 are not limited to those of the illustrated one. An engaging groove for receiving the hook portion 57 may be formed in the back surface side of the molding member 4.

Next, an operation of this embodiment will be explained.

In this embodiment, at first, the inner frame 5 is housed in the body case 1 while the hook portion 57 is positioned at an upper side (an upper side in FIG. 1) of the wristwatch 100. At this time, since the outer diameter of the inner frame 5 is smaller than the diameter of the inner periphery of the body case 1, the inner frame 5 is disposed in the body case 1 without contacting the inner peripheral surface of the body case 1 (Please refer to FIG. 6).

Then, the module member 4 is press-fitted into the inner frame 5 while the liquid crystal panel 41 and the body case 1 face in the same direction. At this time, the surface of the inner side of the module member 4 is brought into contact with the upper ends of the inner-frame side projecting portions 56 on the side wall portion 54 of the inner frame 5, and then the module member 4 rides on the slanted surfaces 561 of the inner-frame side projecting portions 56 while being pushed into the inner frame member 5. The inner-frame side projecting portions 56 are brought into contact with the outside surface of the module member 4 so that the part of the side wall portion which can spread (the spread portions: in a case of this embodiment, the whole part of the side wall portion 54 excluding the cut-out portions) is pushed and spread to make a surface contact with the inner peripheral surface of the body case 1, and is securely fit. As a result of this, the inner frame 5 and the module member 4 held by this inner frame are positioned and securely fit in the body case 1 so as not to generate rattle, etc.

When the module member 4 is press-fitted until the surface of the viewing side of the module member 4 contacts the bottom portion 51 of the inner frame 5, the hook portion 57 is engaged with the surface of the back surface side of the module member 4, thereby preventing the module member 4 from leaving off from the inner frame 5.

After that, the back cover member is threaded in the opening portion 11*b* in the back surface side of the body case 1 so that the back cover member is fixed thereto.

As described above, in this embodiment, since the outer diameter of the inner frame 5 is set to be smaller than the diameter of the inner periphery of the body case 1, the inner frame 5 does not hit the inner surface of the body case 1 and hence is not shaved to produce no shavings when the inner frame 5 is housed within the body case 1. Thus, there is no possibility that the shavings are deposited within the body case 1 and/or on the liquid crystal panel 41 and various electronic parts, etc., thereby causing some troubles.

And, when the module member 4 is press-fitted into the inner frame 5, the parts (the spread portions) of the sidewall portions 54 of the inner frame 5 at which the cut-out portions 55 are not provided are pushed and spread by the module member 4 to fit securely the inner peripheral surface of the body case 1. Therefore, after press-fitting the module member 4, the module member 4 and the inner frame 5 are not rattled in the body case 1 and positioned and fitted securely.

Further, since the plurality of cut-out portions 55 are provided in the side wall portion 54, the side wall portion 54 can easily spread when the module member 4 is press-fitted, so that the side wall portion 54 can securely and closely contact the inner peripheral surface of the body case 1.

Since the inner-frame side projecting portions 56 are provided on the surfaces of the inside of the parts of the side wall portion 54 functioning as the spread portions, the inner-frame side projecting portions 56 contact the outside surface of the module member 4 and can easily and securely spread the spread portions when the module member 4 is press-fitted.

In this embodiment, since the back cover member is configured to be threaded and fixed, no water drop and the like is prevented from entering into the body case 1. In this configuration, the threaded portion 111 for threadably fixing the back cover member is provided in the opening portion 11*b* in the back surface side of the body member 1. In this embodiment, since the outer diameter of the inner frame 5 is set to be smaller than the diameter of the inner periphery of the body case 1, the inner frame 5 does not contact the threaded portion 111 of the body case 1 and hence is not scraped off when the inner member 5 is housed in the body case 1.

Needless to say that the present invention is not limited to the above described embodiment and may be modified.

For example, although in this embodiment the inner-frame side projecting portions 56 are provided on the surface of the inside of the sidewall portion 54 of the inner frame 5, module-side projecting portions 46 for being brought into contact with the inside surface of the side wall portion 54 of the inner frame 5 to push and spread the spread portions when the module member 4 is press-fitted into the inner frame 5 may be provided on the outer peripheral surface of the module member 4.

Figure 8:
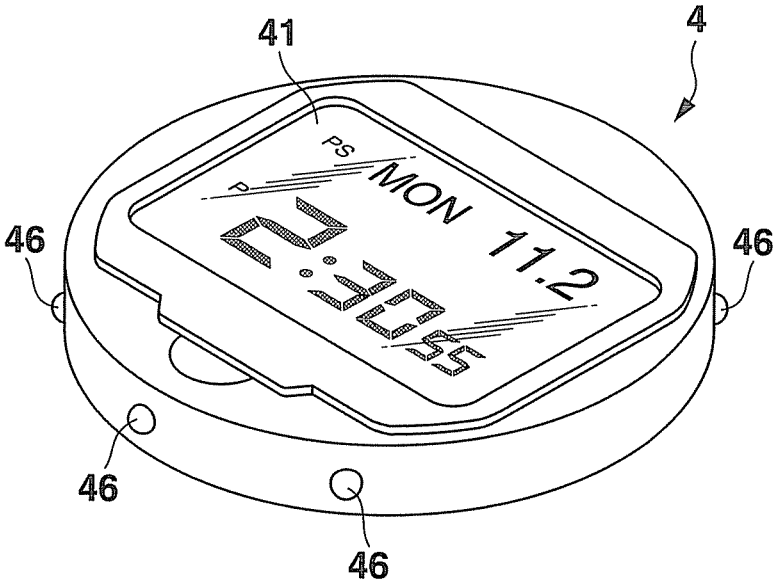
FIG. 8 is a perspective view showing a modification of the module member.

In this case, it is preferable that the module-side projecting portions 46 are provided at positions corresponding to the spread portions of the inner frame 5. However, the module-side projecting portions 46 are shown in FIG. 8 as one example. Each shape, each provided position, the number, etc. of the module-side projecting portions 46 are not limited to those of the illustrated ones.

It may be that the module-side projecting portions 46 are provided on the side of the module member 4 while the inner-frame side projecting portions 56 are provided on the side of the inner frame 5. In this case, the module-side projecting portions 46 and the inner-frame side projecting portions 46 are arranged so that they are not hit each other.

By providing the module-side projecting portions 46 on the side of the module member 4 in such a way described above, the spread portions of the inner frame 5 can be pushed and spread when the module member 4 is press-fitted into the inner frame 5, so that the inner frame 5 closely fit and is secured with the inner peripheral surface of the body case 1.

The arrangement by which at least one part of the side wall portion 54 is pushed and spread by the module member 4 when the module member 4 is press-fitted from the side of the opening portion of the module member 4, so that the surface of the outside closely fit and is secured with the inner peripheral surface of the body case 1, is not limited to providing the inner-frame side projecting portions 56 or providing the module-side projecting portions 46.

Figure 9:
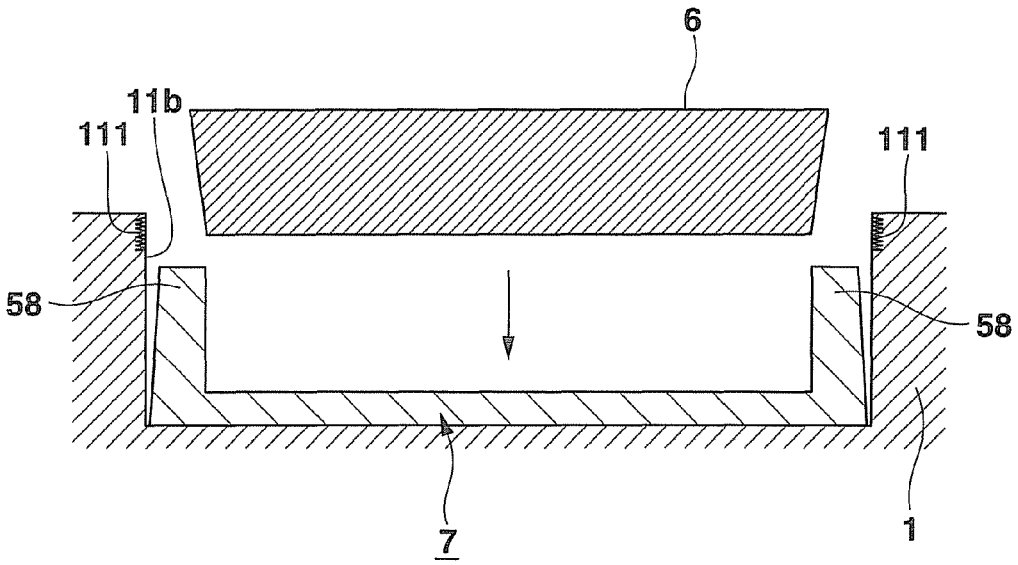
FIG. 9 is a vertical cross sectional view showing a modification of the case unit.

For example, as shown in FIG. 9, by configuring a side surface of a module member 6 to be slanted such that a diameter thereof is gradually enlarged from a side of the side surface which is located at an inner side of the module member 6 when the module member 6 is housed in the body case 1 to a back surface side thereof, the spread portion of an inner frame 7 can be pushed and spread along the slanted side surface of the module member 6 when the module member 6 is press-fitted into the module member 6. In this case, inner-frame side projecting portions may be provided on the inner frame 7 and module-side projecting portions may be provided on the module member 6.

Figure 10:
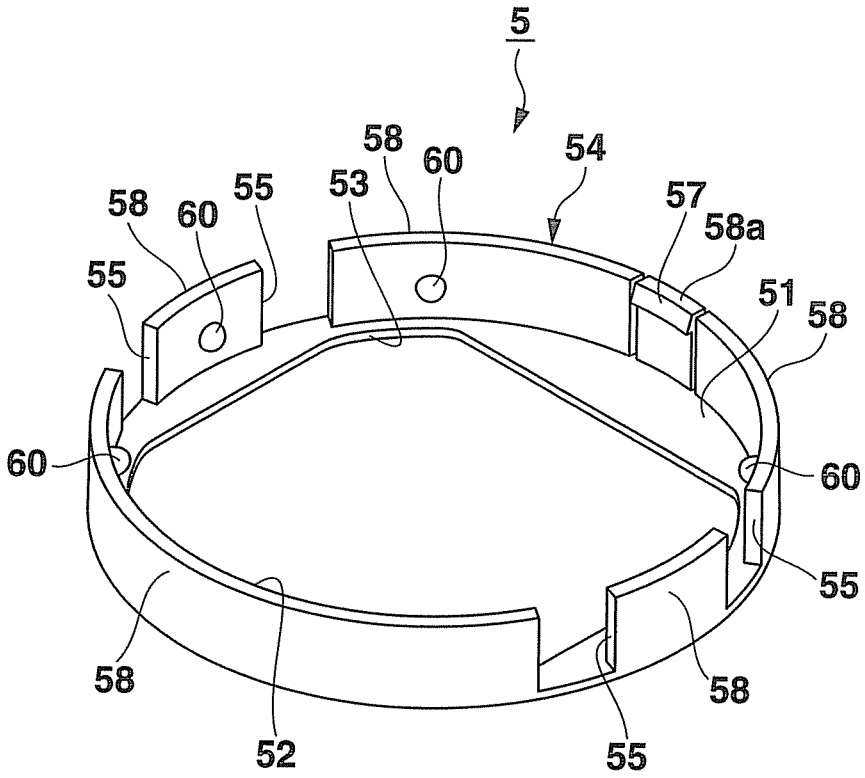
FIG. 10 is a perspective view of a modification of the inner frame.

A shape of the inner-frame side protrusion 56 is not limited to those shown in the above described embodiment. For example, as shown in FIG. 10, a substantially hemispherical protrusion as an inner-frame side protrusion 60 may be provided on the side wall portion 54. Even in a case that the inner-frame side protrusion 60 is the hemispherical protrusion, the spread portion of the inner frame 5 can be pushed and spread.

Figure 11:
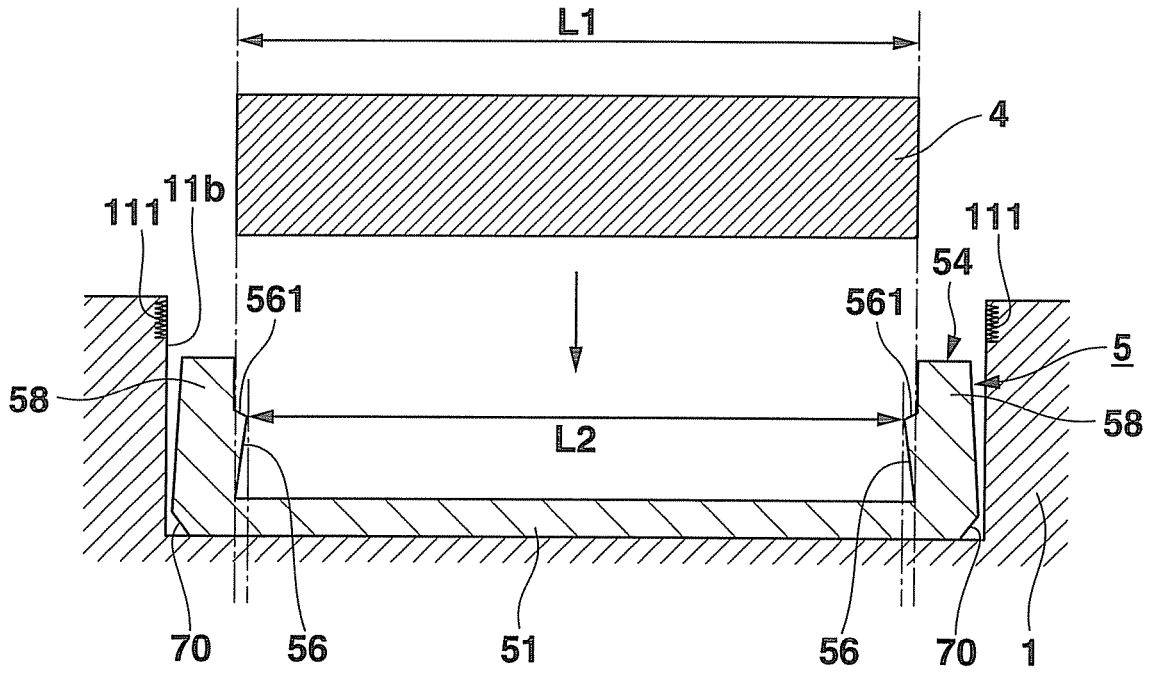
FIG. 11 is a vertical cross-sectional view schematically illustrating a state after the modification of the inner frame is housed in the case member.
Figure 12:
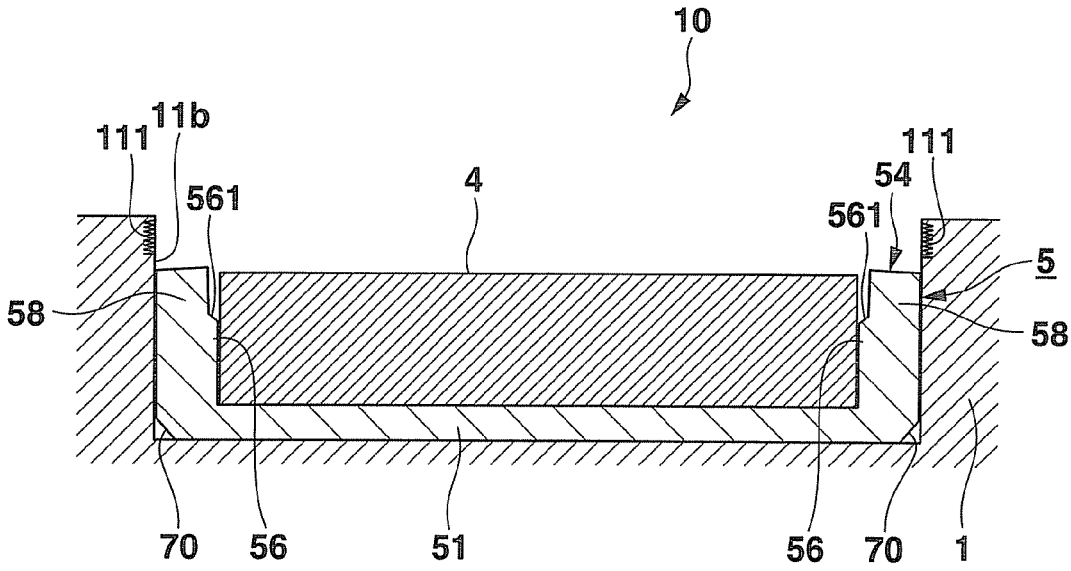
FIG. 12 is a vertical cross-sectional view schematically illustrating a state after the module member is press-fitted into the inner frame shown in FIG. 11.

Further, as shown in FIGS. 11 and 12, by performing a chamfering process on a corner portion of the side wall portion of the inner frame 5 which is located at an inner side of the side wall portion when the inner frame 5 is housed in the body case 1, a chamfered portion 70 may be provided.

By performing the chamfering process in such a way described above, the surface of the inner side of the inner frame 5 is surely prevented from being in contact with the inner peripheral surface of the body case 1 when the inner frame 5 is inserted in the body case 1. Therefore, production of shavings from the inner frame 5 is prevented and hence occurrence of trouble in the wristwatch 100 is prevented.

In the case that the chamfering process is performed, the side wall portion 54 can be easily spread at the portion of the chamfered portion 70 so that the spread portion can be spread more surely to be fit the inner peripheral surface of the body case.

As described above, the case unit (the case unit 10 in FIGS. 6 and 7) relating to this embodiment comprises: a module member (the module member 4 in FIGS. 3, 6, etc.) which holds parts therein; a case member (the body case 1 in FIGS. 2, 6, etc.) which includes an opening portion (the opening portion 11*b* in FIG. 2) and which houses the module member; and an inner frame (the inner frame 5 in FIGS. 4, 5, 6, etc.) which has a side wall portion (the side wall portion 54 in FIGS. 4, 5, 6, etc.) along an inner peripheral surface of this case member, which is arranged to be interposed between the case member and the module member, and which positions the module member within the case member and secures the module member to the case member.

The inner frame is formed to set an outer diameter thereof to be smaller than a diameter of an inner periphery of the case member, and at least one part of the side wall portion is configured as a spread portion which is spread by the module member so as to fit an outside surface thereof on the inner peripheral surface of the case member when the module member is press-fitted from a side of the opening portion.

In the case unit (the case unit 10 in FIGS. 6 and 7) relating to this embodiment, the side wall portion (the side wall portion 54 in FIGS. 4, 5, 6, etc.) has a plurality of cut-out portions (the cut-out portion 55 in FIGS. 4 and 5) each of which is cut out in a direction of a thickness of the case member (the body case 1 in FIGS. 2, 6, etc.), and one or each of all of parts of the sidewall portion located between the cut-out portions provides the spread portion.

In the case unit (the case unit 10 in FIGS. 6 and 7) relating to this embodiment, an inner-frame side projecting portion (the inner-frame side projecting portion 56 in FIGS. 4, 5, 6, etc.) is provided on an inside surface of the spread portion, the inner-frame side projecting portion is brought into contact with an outside surface of the module member, and pushes and spreads outward the spreading portion when the module member (the module member 4 in FIGS. 3, 6, etc.) is press-fitted into the inner frame (the inner frame 5 in FIGS. 4, 5, 6, etc.).

In the case unit (the case unit 10 in FIGS. 6 and 7) relating to this embodiment, a module-side projecting portion (the module-side projecting portion 46) is provided on an outer peripheral surface of the module member (the module member 4 in FIG. 8), the module-side projecting portion is brought into contact with an inside surface of the side wall portion (the side wall portion 54 in FIGS. 4, 5, 6, etc.) of the inner frame, and pushes and spreads outward the spreading portion when the module member is press-fitted into the inner frame (the inner frame 5 in FIGS. 4, 5, 6, etc.).

In the case unit (the case unit 10 in FIGS. 6 and 7) relating to this embodiment, the opening portion (the opening portion 11*b* in FIG. 2) of the case member (the body case 1 in FIGS. 2, 6, etc.) is provided with a threaded portion (the threaded portion 111 in FIG. 2) in which a cover member for covering the opening portion is threaded and fixed.

In the case unit relating to this embodiment, a chamfered process is performed on a corner portion of an outside surface of the side wall portion (the side wall portion 54 in FIGS. 11 and 12), the corner portion is located at a side of the side wall portion away from the opening portion when the inner frame (the inner frame 5 in FIGS. 11 and 12) is housed within the case member (the body case 1 in FIGS. 11 and 12).

An inner frame relating to this invention (the inner frame 5 in FIGS. 4, 5, 6, etc.) is positioned and interposed between a module member (the module member 4 in FIGS. 3, 6, etc.) holding parts therein and a case member (the body case 1 in FIGS. 2, 6, etc.) housing the module member, and positions and secures the module member within the case member by press-fitting the module member from a side of an opening portion (the opening portion 11*b* in FIG. 2) of the case member. The inner frame (the inner frame 5 in FIGS. 4, 5, 6, etc.) has a side wall portion (the side wall portion 54 in FIGS. 4, 5, 6, etc.) which is formed to set an outer diameter thereof to be smaller than a diameter of an inner periphery of the case member and which is arranged along an inner peripheral surface of the case member when the inner frame is housed within the case member. The side wall portion is provided with a plurality of cut-out portions (the cut-out portion 55 in FIGS. 4 and 5) each of which is cut out in a direction of a thickness of the case member. One or each of all of parts of the sidewall portion located between the cut-out portions is configured as a spread portion which is spread by the module member so as to fit an outside surface thereof on the inner peripheral surface of the case member when the module member is press-fitted from a side of the opening portion. And, an inside surface of the spread portion is provided with an inner-frame side projecting portion (the inner-frame side projecting portion 56 in FIGS. 4, 5, 6, etc.) which is brought into contact with an outside surface of the module member and which pushes and spreads outward the spreading portion when the module member is press-fitted into the inner frame.

With this embodiment, since the outer diameter of the inner frame is set to be smaller than the diameter of the inner periphery of the case member, the inner frame does not hit the inner surface of the case member and is not scraped by the inner surface of the case member when the inner frame is housed in the case member.

Further, in this embodiment, since at least the part of the sidewall portion of the inner frame is pushed and spread by the module member to be fit the inner peripheral surface of the case member when the module member is press-fitted into the inner frame, the module member and the inner frame do not rattle in the case member and are securely positioned and fit therein.

Further, in this embodiment, the configuration in which the back cover member is threaded to the case member is explained as one example, the configuration of the back cover member is not limited to this. For example, the back cover member may be fixed to the case member by using screws.

The wristwatch 100 may be of any of the analog type or digital type. The shape of the wristwatch 100 is not limited especially and may be square or elliptical or any other shape in addition to circular.

Further, in this embodiment, although the case in which the inner frame 5 and the case unit 10 are applied to the wristwatch 100 is described as one example, a device to which the inner frame 5 and the case unit 10 are applicable is not limited to the wristwatch 100. For example, the invention may be applicable to various portable terminal devices such as mobile phones, PDAs, and etc., a portable music reproducing device, a small radio, etc.

More further, this invention is not limited to the above described embodiment and various modifications and may be changed in response to requirement.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A case unit comprising:

a module member which holds parts therein;

a case member which includes an opening portion and a housing portion receiving the module member through the opening portion and housing the module member; and an inner frame which has a side wall portion and a module insertion opening portion surrounded by the side wall portion and holding the module member, which is arranged in the housing portion of the case member to direct the module insertion opening portion toward the opening portion of the case member and to interpose the side wall portion between an inner peripheral surface of the housing portion of the case member and the module member, which positions the module member within the housing portion of the case member, and which secures the module member to the case member, the inner frame being formed to set an outer diameter thereof to be smaller than a diameter of the inner peripheral surface of the case member, and at least one part of the side wall portion being configured as a spread portion which is spread by the module member so as to make a surface contact with the inner peripheral surface of the case member at an outside surface of the spread portion and to fit the outside surface thereof on the inner peripheral surface of the case member when the inner frame is arranged in the housing portion of the case member and the module member is press-fitted into the module insertion opening portion.

2. The case unit of claim 1, wherein the side wall portion of the inner frame has a plurality of cut-out portions each of which is cut out in a direction of a thickness of the case member, and one or each of all of parts of the sidewall portion located between the cut-out portions provides the spread portion.

3. The case unit of claim 1, wherein an inner-frame side projecting portion is provided on an inside surface of the spread portion, the inner-frame side projecting portion being brought into contact with an outer peripheral surface of the module member, pushing and spreading outward the spreading portion when the module member is press-fitted into the module insertion opening portion of the inner frame.

4. The case unit of claim 1, wherein a module-side projecting portion is provided on an outer peripheral surface of the module member, the module-side projecting portion being brought into contact with an inside surface of the side wall portion of the inner frame, pushing and spreading outward the spreading portion when the module member is press-fitted into the module insertion opening portion of the inner frame.

5. The case unit of claim 1, wherein the opening portion of the case member is provided with a threaded portion in which a cover member for covering the opening portion is threaded and fixed.

6. The case unit of claim 1, wherein a chamfered process is performed on a corner portion of an outside surface of the side wall portion of the inner frame, the corner portion being located at a side of the side wall portion away from the opening portion of the case member when the inner frame is housed within the housing portion of the case member.

7. An inner frame which is interposed between a module member holding parts therein and a case member, the case member including an opening portion and a housing portion receiving the module member through the opening portion and housing the module member, and which positions and secures the module member within the housing portion of the case member by press-fitting the module member into the inner frame through the opening portion of the case member when the inner frame is arranged in the housing portion of the case member, the inner frame having a side wall portion and a module insertion opening portion surrounded by the side wall portion and directing the opening portion of the case member when the inner frame is arranged in the housing portion of the case member, the side wall portion being formed to set an outer diameter thereof to be smaller than a diameter of an inner peripheral surface of the housing portion of the case member and being arranged along the inner peripheral surface of the case member when the inner frame is arranged in the housing portion of the case member, the side wall portion being provided with a plurality of cut-out portions each of which is cut out in a direction of a thickness of the case member, one or each of all of parts of the sidewall portion located between the cut-out portions being configured as a spread portion which is spread by the module member so as to fit an outside surface thereof on the inner peripheral surface of the case member when the inner frame is arranged in the housing portion of the case member and the module member is press-fitted into the module insertion opening portion, and an inside surface of the spread portion being provided with an inner-frame side projecting portion which is brought into contact with an outer peripheral surface of the module member and which pushes and spreads outward the spreading portion when the module member is press-fitted into the module insertion opening of the inner frame.

* * * * *